US011666965B2

(12) United States Patent
Imai et al.

(10) Patent No.: US 11,666,965 B2
(45) Date of Patent: Jun. 6, 2023

(54) SLAB WARPAGE DETECTION APPARATUS AND METHOD OF DETECTING WARPAGE OF SLAB

(71) Applicant: NIPPON STEEL & SUMITOMO METAL CORPORATION, Tokyo (JP)

(72) Inventors: Shuntaro Imai, Tokyo (JP); Ryousuke Takata, Tokyo (JP); Mitsutoshi Jotoku, Tokyo (JP); Hiroaki Uchiyama, Tokyo (JP); Mitsutaka Hattori, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 707 days.

(21) Appl. No.: 16/074,009

(22) PCT Filed: Feb. 2, 2017

(86) PCT No.: PCT/JP2017/003872
§ 371 (c)(1),
(2) Date: Jul. 30, 2018

(87) PCT Pub. No.: WO2017/135390
PCT Pub. Date: Aug. 10, 2017

(65) Prior Publication Data

US 2019/0039123 A1 Feb. 7, 2019

(30) Foreign Application Priority Data

Feb. 2, 2016 (JP) ..... JP2016-018309

(51) Int. Cl.
*B22D 11/16* (2006.01)
*B22D 11/12* (2006.01)
(Continued)

(52) U.S. Cl.
CPC ..... *B22D 11/1226* (2013.01); *B22D 11/12* (2013.01); *B22D 11/128* (2013.01);
(Continued)

(58) Field of Classification Search
CPC ... B22D 11/1226; B22D 11/128; B22D 11/16; B22D 11/12; B22D 11/1282;
(Continued)

(56) References Cited

U.S. PATENT DOCUMENTS 4,484,285 A * 11/1984 deVersterre ..... B21B 31/028 700/150
4,523,624 A * 6/1985 Dantzig ..... B22D 11/16 164/454
(Continued)

FOREIGN PATENT DOCUMENTS

CN 103372635 A 10/2013
CN 103648687 A 3/2014
(Continued)

OTHER PUBLICATIONS

International Search Report (PCT/ISA/210) issued in PCT/JP2017/003872, dated Apr. 25, 2017.
(Continued)

*Primary Examiner* — Matthew Katcoff
(74) *Attorney, Agent, or Firm* — Birch, Stewart, Kolasch & Birch, LLP

(57) ABSTRACT

Provided is a slab warpage detection apparatus detecting warpage of a slab drawn from a mold in continuous casting equipment. The slab warpage detection apparatus includes a pair of pressing roils that pinches the slab on a rear side of a roll segment, supporting the slab drawn from the mold, in a slab drawing direction, a movement unit that supports the pair of pressing rolls to be movable in a thickness direction of the slab, and a position detecting unit that detects posi-
(Continued)

tions of the pressing rolls in the thickness direction of the slab.

8 Claims, 5 Drawing Sheets

(51) Int. Cl.
*B22D 11/128* (2006.01)
*B22D 11/20* (2006.01)
*B21B 1/46* (2006.01)

(52) U.S. Cl.
CPC ..... *B22D 11/1282* (2013.01); *B22D 11/1287* (2013.01); *B22D 11/16* (2013.01); *B22D 11/20* (2013.01); *B21B 1/463* (2013.01)

(58) Field of Classification Search
CPC ..... B22D 11/1287; B22D 11/20; B21B 1/463; B21B 1/46; B21B 13/22; B21B 37/58; B21B 37/60; B21B 37/62; B21B 38/10; B21B 39/006; B21B 2271/02
See application file for complete search history.

(56) References Cited

U.S. PATENT DOCUMENTS 5,031,687 A * 7/1991 Bollig ..... B22D 11/1226 164/417
5,706,882 A * 1/1998 Fellus ..... B22D 11/0622 164/154.8
6,491,088 B1 * 12/2002 Sucker ..... B22D 11/1206 164/476
8,205,662 B2 * 6/2012 Girgensohn ..... B22D 11/081 164/454
8,336,602 B2 * 12/2012 Huellen ..... B22D 11/16 164/451
2001/0027853 A1 * 10/2001 Donini ..... B21B 37/68 164/452
2009/0116041 A1 5/2009 Jepsen et al.
2012/0151980 A1 * 6/2012 Denker ..... B21B 38/10 72/31.08
2015/0367408 A1 * 12/2015 Imai ..... B22D 11/1287 72/205

FOREIGN PATENT DOCUMENTS

| | | | | |
|---|---|---|---|---|
| CN | 203621411 | U | 6/2014 | |
| DE | 31 16 278 | A1 | 11/1982 | |
| EP | 1125658 | A1 | 8/2001 | |
| GB | 2 100 475 | A | 12/1982 | |
| JP | 31-002815 | B | 4/1956 | |
| JP | 53-122624 | A | 10/1978 | |
| JP | 55-75864 | A | 6/1980 | |
| JP | 62-009756 | A | 1/1987 | |
| JP | 3-254344 | A | 11/1991 | |
| JP | 6-335755 | A | 12/1994 | |
| JP | 2000-176616 | A | 6/2000 | |
| JP | 2003-019546 | A | 1/2003 | |
| JP | 2009-539074 | A | 11/2009 | |
| KR | 100966978 | B1 * | 6/2010 | ..... B22D 11/00 |
| RU | 2399447 | C2 | 9/2010 | |
| RU | 2479367 | C2 | 4/2013 | |
| SU | 977079 | A | 12/1982 | |

OTHER PUBLICATIONS

Office Action issued in Taiwanese Patent Application No. 106103574, dated Nov. 30, 2017.
Written Opinion (PCT/ISA/237) issued in PCT/JP2017/003872, dated Apr. 25, 2017.
Chinese Office Action and Search Report, dated Sep. 4, 2019, for Chinese Application No. 201780008834.9, with an English translation of the Search Report.
Russian Office Action and Search Report, dated May 7, 2019, for Russian Application No. 2018128593, with an English translation.
Extended European Search Report for counterpart European Application No. 17747541.5, dated Oct. 2, 2019.
Chinese Office Action and Search Report for corresponding Chinese Application No. 201780008834.9, dated Apr. 30, 2020, with an English translation.

* cited by examiner

SLAB WARPAGE DETECTION APPARATUS AND METHOD OF DETECTING WARPAGE OF SLAB

TECHNICAL FIELD OF THE INVENTION

The present invention relates to a slab warpage detection apparatus detecting warpage of a slab drawn from a mold in continuous casting equipment, and a method of detecting warpage of a slab using the slab warpage detection apparatus.

Priority is claimed on Japanese Patent Application No. 2016-018309, filed on Feb. 2, 2016, the content of which is incorporated herein by reference.

BACKGROUND ART

In a case where a slab is subjected to continuous casting in continuous casting equipment, sometimes the slab is not uniformly cooled due to a water leak from cooling water piping, clogging of spray chips, and the like, and warpage is generated in the slab. There is concern that if a warpage amount of a slab exceeds a predetermined amount, the slab interferes with a conveying apparatus and the like, so that an operation is halted.

Therefore, in the conventional art, a method of reducing warpage of a slab drawn from a mold in continuous, casting equipment has been proposed.

For example, Patent Document 1 has proposed a method of straightening warpage of a slab using a reduction roll in a slab conveyance table.

In addition, Patent Documents 2 and 3 have proposed a method of straightening warpage of a slab by restricting conditions for cooling a slab.

PRIOR ART DOCUMENT

Patent Document

[Patent Document 1] Japanese Unexamined Patent Application, First Publication No. H06-335755

[Patent Document 2] Japanese Unexamined Patent Application, First Publication No. 2000-176616

[Patent Document 3] Japanese Unexamined Patent Application, First Publication No. 2003-019546

DISCLOSURE OF THE INVENTION

Problems to be Solved by the Invention

In methods according to Patent Documents 1 to 3, methods of straightening warpage of a slab are disclosed. However, a unit sensing warpage of a slab and a unit measuring a warpage amount are not disclosed. For example, it may be conceivable to measure the amount of displacement of a slab using a laser displacement meter or the like. However, in continuous casting equipment, the use environment poor, and the laser displacement meter or the like deteriorates in an early stage due to heat, vapor, and the like. Accordingly, it is assumed that the amount of displacement of a slab cannot be stably measured for a long period of time.

Here, in a roll segment supporting a slab drawn from a mold in continuous casting equipment, since a slab is fixed by the roll segment, warpage is not manifested. Warpage is manifested at the point of time a slab comes out of the roll segment. However, the amount of displacement thereof itself is not significant, and warpage is sensed for the first time at the point of time a slab is drawn long. Therefore, there has been a problem that warpage cannot be sensed in an early stage and an operation stop cannot be avoided.

Particularly, in vertical-type continuous casting equipment in which a slab is drawn downward in a vertical direction and the slab is cut into predetermined lengths by a cutter, if significant warpage is generated in the slab, there is a problem that the slab rides on a conveying roll which pinches and supports the slab on a side below the cutter, so that the slab cannot be supported any longer and an operation stops. Therefore, there is demand for sensing warpage of a slab in an early stage and appropriately straightening warpage.

The present invention has been made in consideration of the foregoing situations, and an object thereof is to provide a slab warpage detection apparatus which senses warpage of a slab drawn from a mold in an early stage and is capable of measuring a warpage amount thereof, and a method of detecting warpage of a slab using the slab warpage detection apparatus.

Means for Solving the Problem (1) In order to solve the problem above, according to an aspect of the present invention, there is provided a slab warpage detection apparatus detecting warpage of a slab drawn from a mold in continuous easting equipment. The slab warpage detection apparatus includes a pair of pressing rolls that pinches the slab on an exit side of a roll segment supporting the slab drawn from the mold, a movement unit that supports the pair of pressing rolls to be movable in a thickness direction of the slab, and a position detecting unit that detects positions of the pressing rolls in the thickness direction of the slab.

According to the slab warpage detection, apparatus having this configuration, the slab warpage detection apparatus includes the pair of pressing rolls that pinches the slab, the movement unit that supports the pair of pressing rolls to be movable in the thickness direction of the slab, and the position detecting unit that detects the positions of the pressing rolls in the thickness direction of the slab. Therefore, the pair of pressing rolls moves in the thickness direction of the slab in a manner following a shape of the slab, and warpage of the slab is sensed by detecting the positions of the pair of pressing rolls in the thickness direction of the slab, so that a warpage amount thereof can be accurately measured. In addition, a situation of warpage of the slab can be continuously detected.

In the present invention, in a case of considering a cross section including a drawing direction of the slab, warpage denotes displacement of a position in a direction perpendicular to the drawing direction of the slab. In the present invention, warpage of a slab in thickness becomes a target to be detected by the slab warpage detection apparatus. In addition, the thickness direction of the slab in the present invention indicates a thickness direction of the slab immediately below the roll segment.

In addition, in the present invention, the pressing rolls and the movement unit are provided at the rear of the roll segment, supporting the slab drawn from the mold, in the slab drawing direction (direction in which a slab is conveyed). Therefore, the warpage amount of a slab can be measured in an early stage, and a stop of an operation due to warpage of the slab can be avoided by taking appropriate countermeasures such as straightening this warpage.

(2) Here, in the slab warpage detection apparatus according to the aspect described above, it is preferable that warpage of the slab is straightened by adjusting a balance of pressing forces of the pair of pressing rolls, for example, in a case where an amount of displacement of the positions of the pressing rolls in the thickness direction of the slab exceeds a predetermined value. The predetermined value of the amount of displacement of the positions of the pressing rolls in the thickness direction of the slab is a value obtained based on the past performance from an allowable value of the warpage amount with which a slab can be stably conveyed without riding on a lower conveying roll. This predetermined value is set in accordance with a roll size of the lower conveying roll.

In this case, warpage of the slab can be straightened in an early stage by adjusting the pressing forces of the pair of pressing rolls at the point of time the amount of displacement of the positions of the pressing rolls in the thickness direction of the slab exceeds the predetermined value is sensed, so that an operation stop due to warpage of the slab can be avoided. That is, in regard to a slab which is being conveyed at a predetermined speed, an operation stop due to warpage of the slab can be avoided by straightening the warpage of the slab at the point of time the warpage of the slab can be straightened.

(3) In the slab warpage detection apparatus according to (1) or (2), the slab having a center solid phase ratio of 70% or higher may be used as a detection target. In this case, the slab is prevented from expanding due to static pressure, so that warpage can be more accurately detected.

(4) In the slab warpage detection apparatus according to any one of (1) to (3), the continuous casting equipment may be a vertical type. In this case, in vertical-type continuous casting equipment in which a slab is drawn downward in a vertical direction, the warpage amount thereof can be measured by sensing warpage of a slab, in an early stage, conveyed without going through a step such as bending after being drawn from the mold.

(5) According to another aspect of the present invention, there is provided a method of detecting warpage of a slab using the slab warpage detection apparatus according to any one of (1), (3), and (4). The method of detecting warpage of a slab includes detecting warpage of a slab by causing the position detecting unit to detect the positions of the pressing rolls when the pair of pressing rolls moves in the thickness direction of the stab in a manner following a shape of the slab in a state where the slab is pinched by the pair of pressing rolls.

According to the method of detecting warpage of a slab having this configuration, the slab warpage detection apparatus described above is used. Therefore, warpage of the slab can be sensed in an early stage and the warpage amount thereof can be accurately measured when the positions of the pressing rolls when the pair of pressing rolls moves in the thickness direction of the slab in a manner following the shape of the slab is detected by the position detecting unit.

In a case where a slab is pinched by the pair of pressing rolls, the pressing rolls may be in a state of being in contact with the slab.

On the other hand, the slab may be pressed and pinched by the pair of pressing rolls with pressing forces equal to each other. In this case, there is no need for each of the pressing forces to strictly coincide with each other. A difference may be present between pressing forces to the extent that a slab is not deformed. An allowable difference between pressing forces varies due to the material, the cross-sectional shape, and the like of a slab. Generally, it is preferable that the allowable difference is 20 t or lower.

(6) In addition, according to another aspect of the present invention, there is provided a method of detecting warpage of a slab using the slab warpage detection apparatus according to (2) to (4). The method of detecting warpage of a slab includes detecting warpage of a slab by causing the position detecting unit to detect the positions of the pressing rolls when the pair of pressing rolls moves in the thickness direction of the slab in a manner following a shape of the slab in a state where the slab is pinched by the pair of pressing rolls, and straightening warpage of the slab by adjusting pressing forces of the pair of pressing rolls in a case where an amount of displacement of the positions of the pressing rolls in the thickness direction of the slab exceeds a predetermined value.

According to the method of detecting warpage of a slab having this configuration, the slab warpage detection apparatus described above used. Therefore, warpage of the slab can be sensed in an early stage and the warpage amount thereof can be accurately measured.

Then, in a case where the amount of displacement of the positions of the pressing rolls in the thickness direction of the slab exceeds the predetermined value, warpage of the slab is configured to be straightened by adjusting pressing forces of the pair of pressing rolls. Therefore, warpage of the slab can be straightened in an early stage, so that an operation stop due to warpage of the slab can be avoided.

Effects of the Invention

According to each of the aspects of the present invention described above, it is possible to provide the slab warpage detection apparatus which senses warpage of the slab drawn from a mold in an early stage and is capable of measuring a warpage amount thereof, and the method of detecting warpage of a slab using the slab warpage detection apparatus.

EMBODIMENTS OF THE INVENTION

Hereinafter, a slab warpage detection apparatus and a method of detecting slab warpage according to embodiments of the present invention will be described with reference to the accompanying drawings. The present invention is not limited to only the following embodiments.

First continuous easting equipment 10 in which a slab warpage detection apparatus 20 and a method of detecting slab warpage according to the present embodiment are applied will be described.

Figure 1:
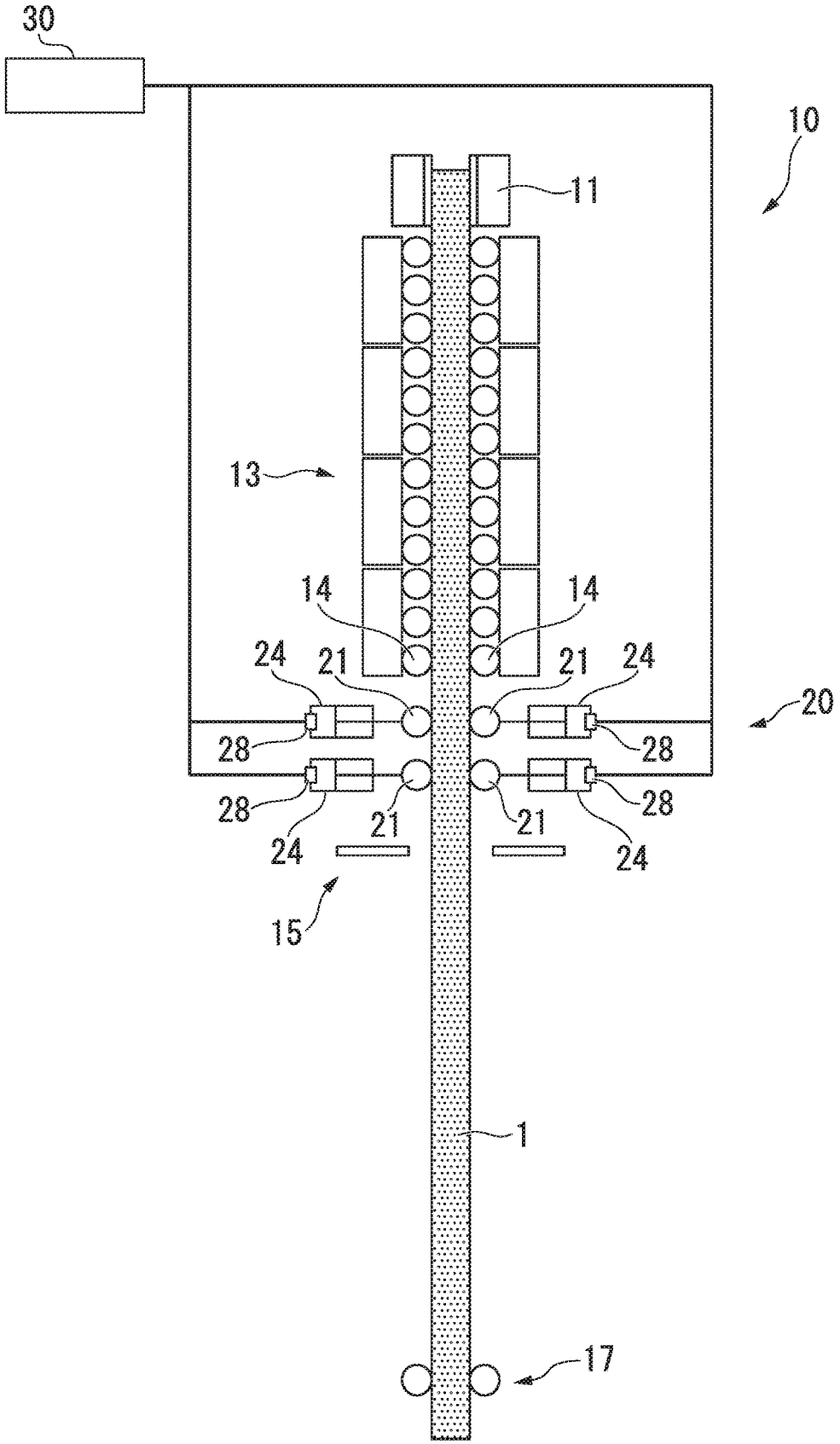
FIG. 1 is a view describing continuous easting equipment in which a slab warpage detection apparatus and a method of detecting slab warpage according to an embodiment of the present invention is applied.

The continuous casting equipment 10 illustrated in FIG. 1 is a vertical-type continuous casting machine including a mold 11, a roll segment 13 that is disposed in a plurality of stages below this mold 11 and supports a slab 1 drawn from the mold 11, cutters 15 that cut the slab 1, and a lower conveying rolls 17 that support and convey the slab 1 on a side below the cutters 15.

In the present embodiment an example in which the slab 1 is pressed and pinched by a pair of pressing rolls 21 with pressing forces equal to each other is described. However, the pressing roils 21 may be in a state of being is contact with the slab 1.

Then, the slab warpage detection apparatus 20 according to the present embodiment is provided between the roll segment 13 and the cutters 15. As illustrated in FIG. 1, it is preferable that the slab warpage detection apparatus 20 is provided immediately below the roll segment 13 (on an upstream side of a different apparatus located on a downstream side of the roll segment 13 in a direction in which a slab is conveyed). That is, before going through a different step (before the slab 1 is conveyed to a different apparatus), it is preferable that the slab warpage detection apparatus 20 detects warpage of the slab 1 cooled in the roll segment 13. In such a configuration, warpage of the slab 1 can be sensed in an early stage, and a warpage amount thereof can be measured.

Figure 2:
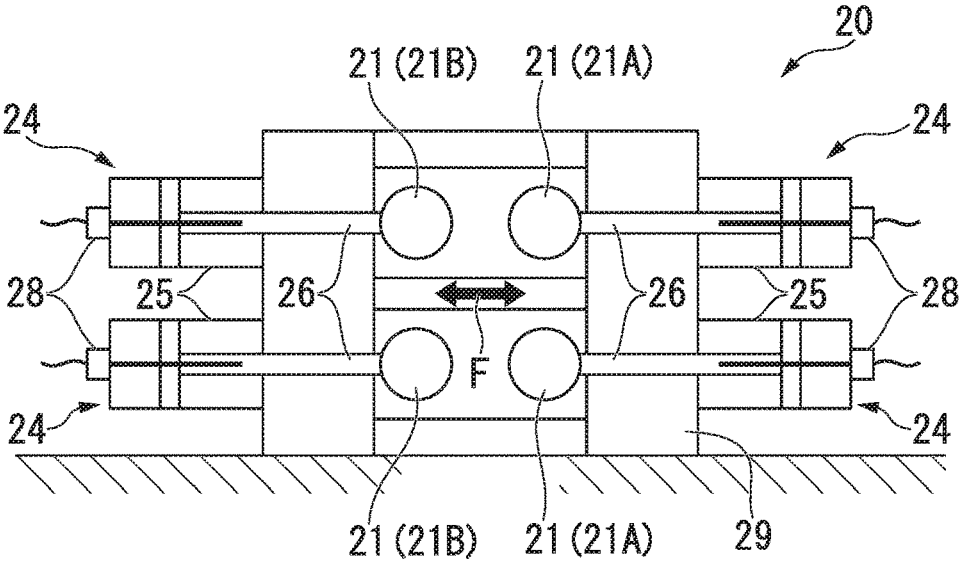
FIG. 2 is a side view for describing a schematic configuration of the slab warpage detection apparatus described above.
Figure 3:
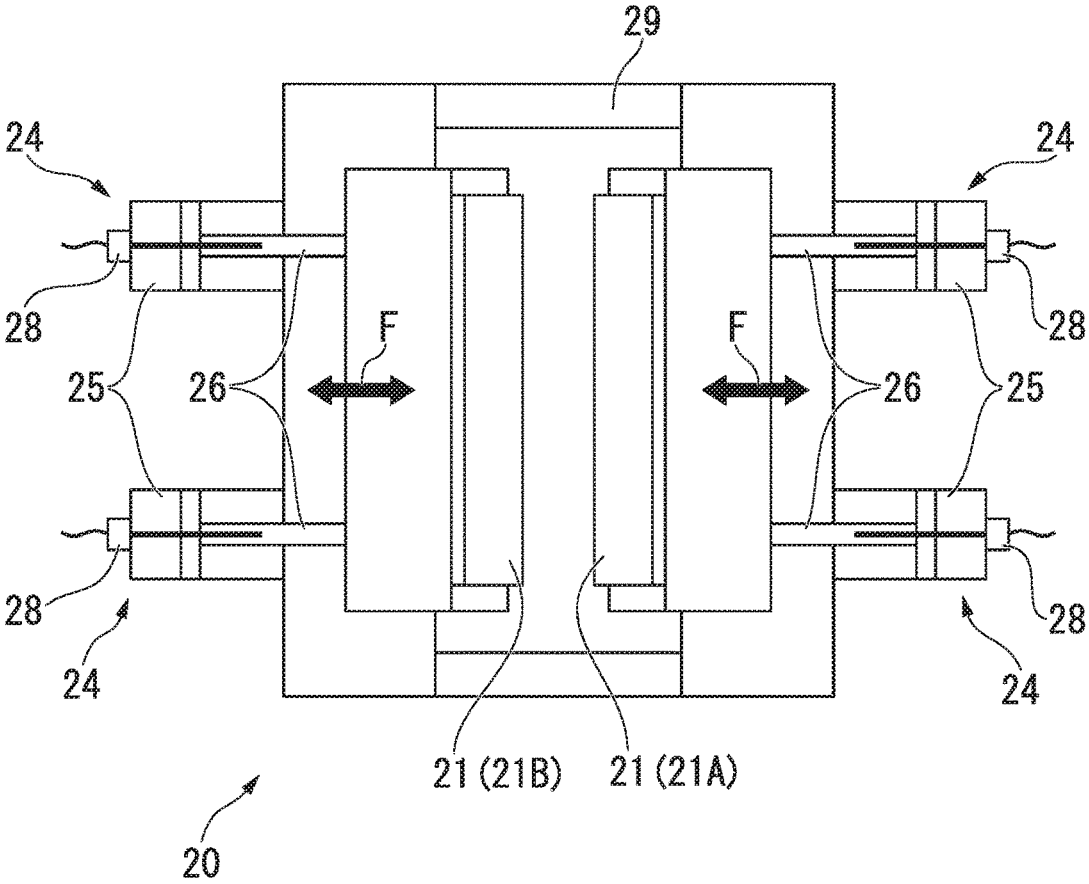
FIG. 3 is a plan view of the same slab warpage detection apparatus.

As illustrated in FIGS. 2 and 3, this slab warpage detection apparatus 20 includes the pair of pressing rolls 21 (21A and 21B) that presses and pinches the slab 1, movement units 24 that respectively support the pressing rolls 21 to be movable in a pressing direction F of the slab 1, and position detecting units 28 that detect positions of the pressing rolls 21 in the pressing direction F.

In the present embodiment, as illustrated in FIG. 2, the pair of pressing rolls 21 (21A and 21B) pinching the slab 1 in its sheet thickness direction is provided in two stages in a drawing direction of the slab 1.

In addition, the movement unit 24 supporting the pressing roll 21 includes a cylinder 25 fixed to a frame 29, and a rod portion 26 disposed to be retractable in a horizontal direction from this cylinder 25. The pressing roll 21 is provided at a tip of the rod portion 26. In the present embodiment, as illustrated in FIGS. 2 and 3, the movement units 24 are constituted of eight cylinders 23 respectively basing the rod portions 26. Then, one pressing roll 21 is provided with respect to the tips of the pair of rod portions 26. Therefore, in the present embodiment, four pressing rolls 21 are supported by four pairs of rod portions 26.

The position detecting unit 28 is installed in the rod portion 26 of each of the cylinders 25 and detects the position of the pressing roll 21, provided at the tip of each of the rod portions 26, in the pressing direction F. As illustrated in FIG. 1, each of position detecting units 28 is connected to a control device 30, and information of the positions of the pressing rolls 21 in the pressing direction F detected by these position detecting units 28 are transmitted to the control device 30.

Next, a method of detecting warpage of a slab using the slab warpage detection apparatus 20 according to the present embodiment will be described.

The slab 1 drawn from the mold 11 is fixed and supported by the roll segment 13 and is drawn downward in a vertical direction. A cooling unit is provided in the roll segment 13. Here, the slab 1 is cooled by the cooling unit provided in the roll segment 13. In an exit part of the roll segment 13, solidification has progressed to the extent that the slab 1 does not expand due to static pressure. Generally, a center solid phase ratio is 70% or higher.

In addition, since the slab 1 is fixed and supported by the roll segment 13, even in a case where cooling is not uniformly performed, warpage of the slab 1 is not manifested. At the point of time the slab 1 comes out of the roll segment 13, the slab 1 can be deformed in a relatively free manner, and warpage is manifested.

The slab warpage detection apparatus 20 according to the present embodiment may be provided between the roll segment 13 and the cutters 15 for cutting the slab 1 in the continuous casting equipment 10. In this case, particularly, in the continuous easting equipment 10 in which the slab 1 is drawn downward in the vertical direction and the slab 1 is cut into predetermined lengths by the cutters 15, it is possible to prevent the slab 1 from riding on conveying rolls 17 which pinch and support the slab 1 on a downstream side of the cutters 15, to prevent the slab 1 from being not able to be supported any longer, and to prevent an operation from stopping.

In the slab warpage detection apparatus 20 according to the present embodiment, on the exit side of the roll segment 13, the slab 1 is in a state of being pressed by the pair of pressing rolls 21 (21A and 21B) in a thickness direction of the slab 1 with pressing forces equal to each other. In a case where the slab 1 is pressed by the pair of pressing rolls 21 (21A and 21B) with pressing forces equal to each other, there is no need for each of the pressing forces in the horizontal direction to strictly coincide with each other. A difference may be present between pressing forces to the extent that the slab 1 is not deformed. An allowable difference between pressing forces varies due to the material, the cross-sectional shape, and the like of a slab. It is preferable that the allowable difference is 20 t or lower.

Figure 4:
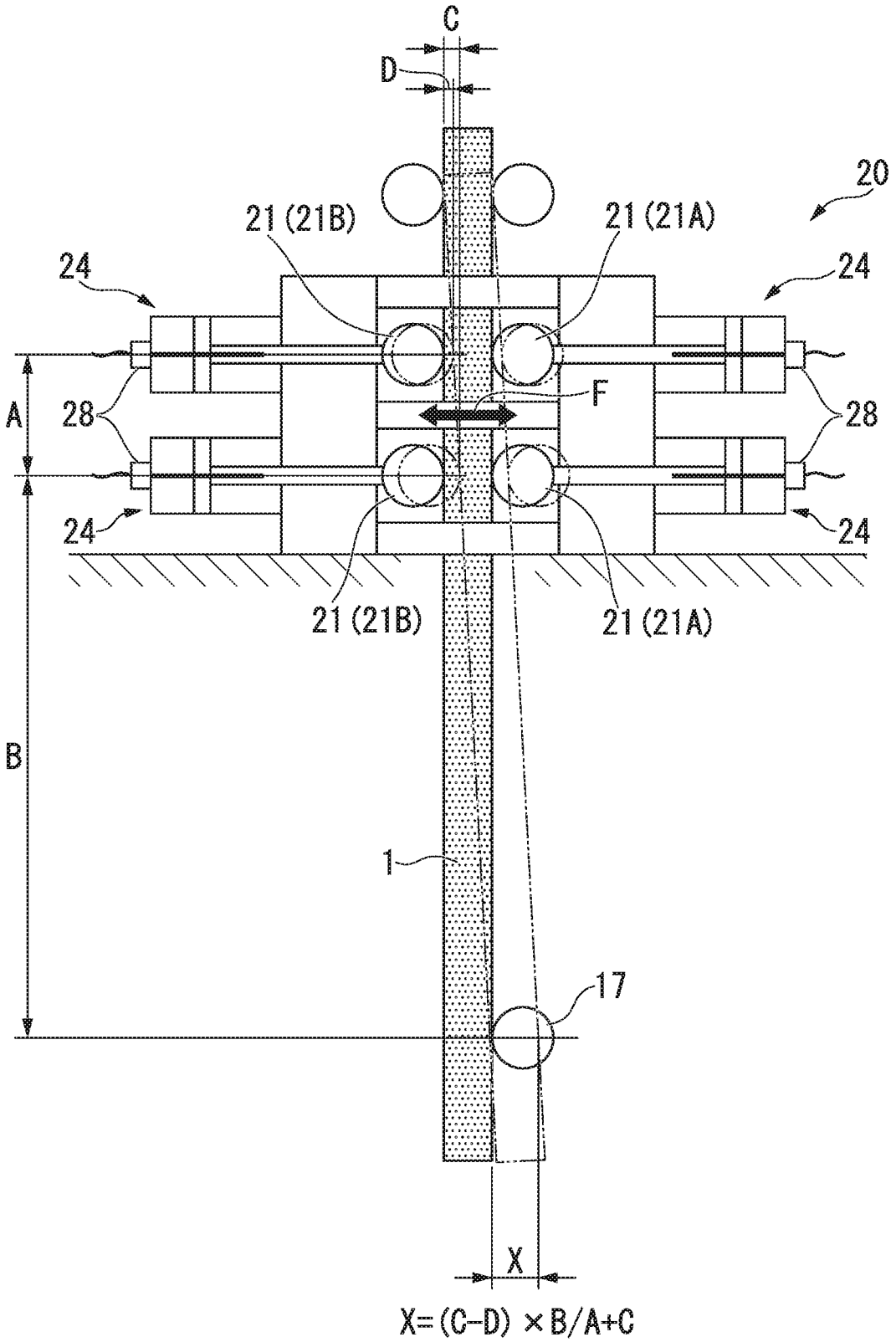
FIG. 4 is a side view illustrating a method of calculating a warpage amount in the same slab warpage detection apparatus.

In this state, in a case where warpage is generated in the slab 1, the pressing rolls 21 move along the pressing direction F in a manner following the shape of the slab 1. In FIG. 4, as indicated with two-dot chained line, the pressing rolls 21 move to the right side. These positions of the pressing rolls 21 are detected by the position detecting units 28 installed in the rod portions 26 of the cylinders 25. Then, information of the positions of the pressing rolls 21 in the pressing direction F is transmitted from the position detecting units 28 to the control device 30.

In the control device 30, from information of the positions of the pressing rolls 21 detected by the position detecting units 28, an amount of displacement of the positions of the pressing rolls 21 on the upper side in the thickness direction of the slab 1 and an amount of displacement of the positions of the pressing rolls 21 on the lower side in the thickness direction of the slab 1 are calculated. Then, in addition to a distance A between the pressing rolls 21 on the upper side and the pressing rolls 21 on the lower side, and a distance B between the pressing rolls 21 on the lower side and the lower conveying rolls 17 which are set in advance, an amount C of displacement of the positions of the pressing rolls 21 on the lower side and an amount D of displacement of the positions of the pressing rolls 21 on the upper side are calculated. A warpage amount X in parts of the lower conveying rolls 17 is calculated by the following (Expression 1). For example, the unit of mm can be used as each of the variables, $$X=(C-D)\times B/A+C \quad \text{(Expression 1)}$$

If this warpage amount X exceeds a predetermined value, there is concern that the slab 1 rides on the lower conveying rolls 17, so that conveyance of the slab 1 has to be stopped. Therefore, at the point of time the slab 1 comes out of the roll segment 13, there is a need to straighten warpage of the slab 1 as necessary by sensing warpage of the slab 1 based on information of the positions of the pressing rolls 21.

Figure 5:
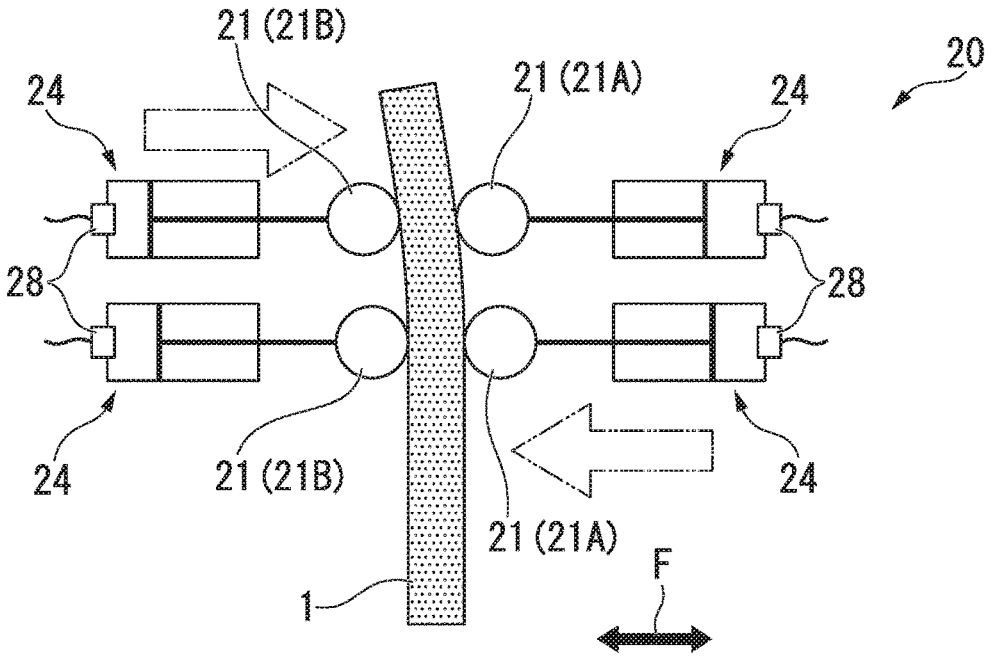
FIG. 5 is a side view illustrating a method of straightening warpage of a slab in the same slab warpage detection apparatus.

In the present embodiment, as illustrated in FIG. 5, warpage is straightened by adjusting pressing forces of the pressing rolls 21 (21A and 21B) and causing the slab 1 to be subjected to bending deformation. That is, warpage of the slab 1 is straightened by generating a difference between pressing forces of the pressing rolls 21A on one side and pressing forces of the pressing rolls 21B or the other side and applying bending deformation to the slab 1, in the pair of pressing rolls 21 (21A and 21B) pinching the slab 1.

In the present embodiment, as illustrated in FIG. 5, warpage is straightened by causing the pair of pressing rolls 21 (21A and 21B) on the upper side and the pair of pressing rolls 21 (21A and 21B) on the lower side to be relatively move in the opposite directions and causing the slab 1 to be subjected to bending deformation.

According to the slab warpage detection apparatus 20 and the method of detecting slab warpage according to the present embodiment having a configuration as described above, the slab warpage detection apparatus 20 includes the pair of pressing rolls 21 (21A and 21B) that presses and pinches the slab 1, the movement units 24 that support these pressing rolls 21 to be movable in the pressing direction F, and the position defecting units 28 that defect the positions of the pressing rolls 21 in the pressing direction F. Therefore, in a state where the slab 1 is pressed by the pair of pressing rolls 21 (21A and 21B) with pressing forces equal to each other, warpage of the slab 1 can be sensed by causing the position detecting units 28 to detect the positions of the pressing rolls 21 when the pressing rolls 21 move in the pressing direction F in a manner following the shape of the slab 1.

In addition, the pair of pressing rolls 21 (21A and 21B) is provided at the exit part of the roll segment 13 fixing and supporting the slab 1 drawn from the mold 11. Therefore, at the point of time warpage is manifested, warpage of the slab 1 can be sensed in an early stage, so that the warpage amount can be accurately measured.

Moreover, in the present embodiment, as illustrated in FIG. 4, the warpage amount X of the positions of the lower conveying rolls 17 can be estimated from the amount of displacement of the positions of the pair of pressing rolls 21 (21A and 21B) in the pressing direction F provided at the exit part of the roll segment 13. Thus, before the slab 1 arrives at the lower conveying rolls 17, the slab 1 can be prevented from riding on the lower conveying rolls 17 by straightening warpage, so that an operation can be stably performed.

In addition, in the present embodiment, a case where two sets of the pair of pressing rolls 21 (21A and 21B) are vertically provided is illustrated. In the case of such a form, warpage of the slab 1 can be sensed from a difference between the amount of displacement of the positions of the pressing rolls 21 on the upper side in the pressing direction F and the amount of displacement of the positions of the pressing rolls 21 on the lower side in the pressing direction F.

Moreover, when warpage of the slab 1 is straightened, warpage of the slab 1 can be straightened in a relatively simple manner by causing the pair of pressing rolls 21 (21A and 21B) on the tipper side and the pair of pressing rolls 21 (21A and 21B) on the lower side to move in directions opposite to each other by applying bending deformation to the slab 1.

Hereinabove, the slab warpage detection apparatus and the method of detecting slab warpage according to the embodiment of the present invention have been described. However, the present invention is not limited to only the forms described above, and suitable changes can be made within a range not departing from the technical ideas of the invention.

Figure 6:
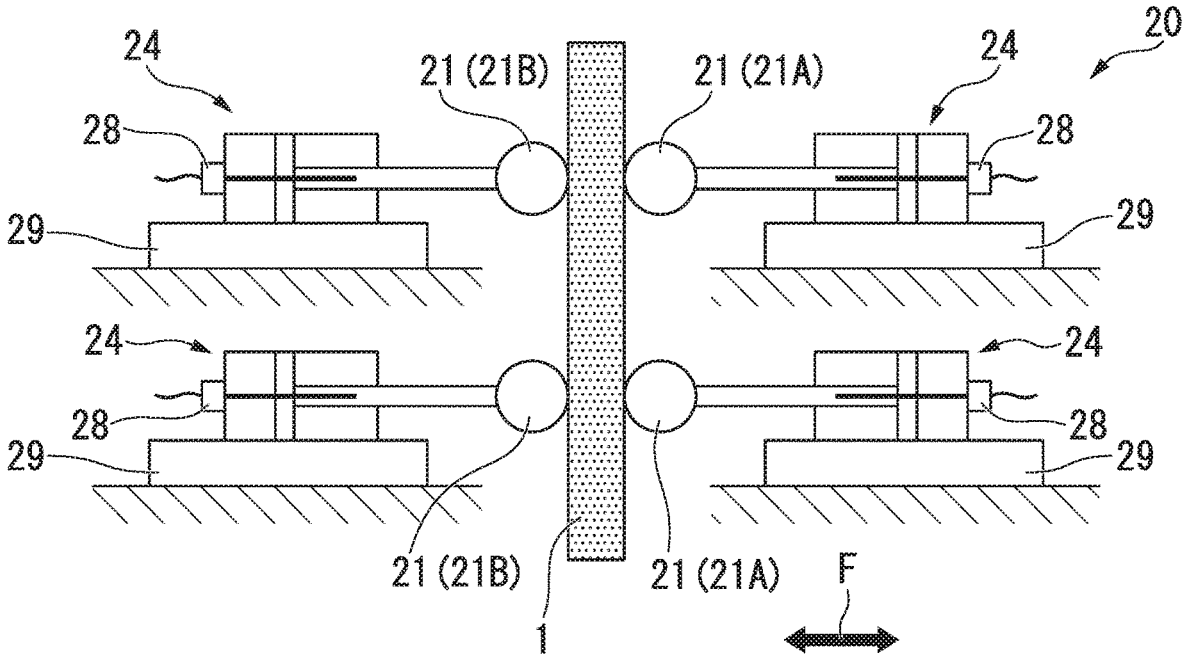
FIG. 6 is a side view for describing a schematic configuration of a slab warpage detection apparatus according to another embodiment of the present invention.

For example, in the description of the present embodiment as illustrated, in FIG. 2, the movement units supporting the pair of pressing rolls 21 (21A and 21B) on the upper side and the movement units supporting the pair of pressing rolls 2 (21A and 21B) on the lower side are fixed to the same frame 29. However, the embodiment is not limited thereto. As illustrated in FIG. 6, the movement units 24 supporting the pair of pressing rolls 21 (21A and 21B) on the upper side and the movement units 24 supporting the pair of pressing rolls 21 (21A and 21B) on the lower side may be fixed to the frames 29 different from each other.

Figure 7:
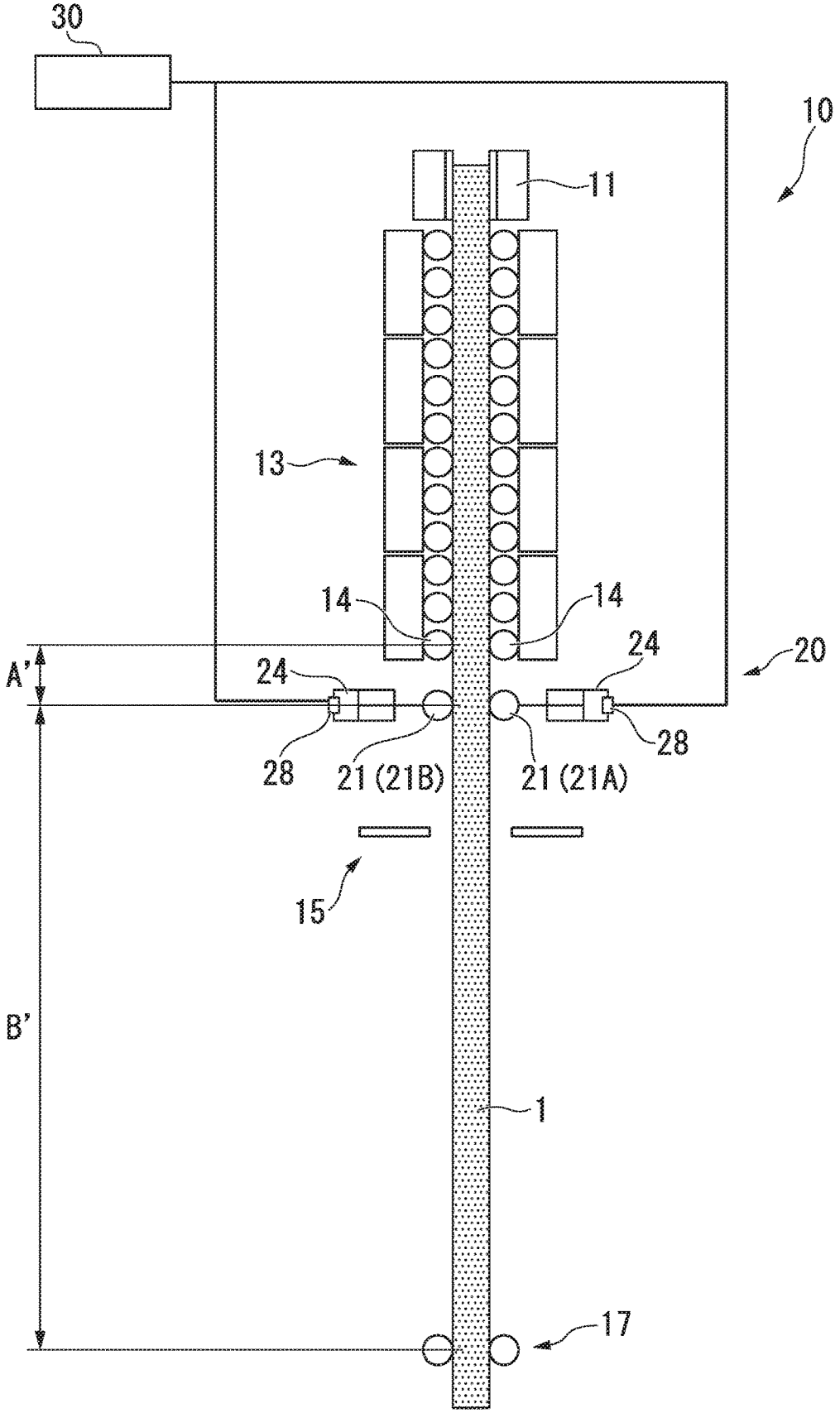
FIG. 7 is a side view for describing a schematic configuration of a slab warpage detection apparatus according to still another embodiment of the present invention.

Moreover, in the description of the present embodiment, two sets of the pair of pressing rolls are provided. However, the embodiment is not limited thereto. As illustrated in FIG. 7, one set of the pair of pressing rolls 21 (21A and 21B) may be provided. Even in this case, the warpage amount of the slab 1 can be measured from a distance between a pinching roll 14 and the pressing rolls 21 constituting the roll segment 13, and the amount of displacement of the positions of the pair of pressing rolls 21 (21A and 21B) in the pressing direction F. For example, as illustrated in FIG. 7, in a case where a distance between the pinching roll 14 of the lowermost portion and the pressing rolls 21 is A', a distance between the pressing rolls 21 and the lower conveying rolls 17 is B', and the amount of displacement of the positions of the pressing rolls 21 in a pressing direction is E in a plurality of pinching rolls 14 constituting the roll segment 13, similar to the case described above, the warpage amount X can be calculated by the following (Expression 2). For example, the unit of mm can be used as each of the variables.

$$X=E\times B'/A'+E \quad \text{(Expression 2)}$$

In addition, in the description of the present embodiment, the position detecting units 28 are provided in the movement units 24 on both sides of the pair of pressing rolls 21 (21A and 21B). However, the embodiment is not limited thereto. The position detecting unit 28 may be provided on only the movement unit 24 on one side.

In addition, in the description of the present, embodiment, the movement unit 24 has a cylinder structure. However, the embodiment is not limited thereto. For example, the movement unit 24 may move a mechanical screw using an electric motor.

In addition, in the description of the present embodiment the pressing rolls 21 (21A and 21B) are configured to straighten warpage of the slab 1. However, the embodiment is not limited thereto. There is no limitation for the method of straightening warpage. For example, cooling may be performed on only one surface of the slab 1. When cooling is performed on only one surface of the slab 1, a temperature difference is generated in the thickness direction of the slab 1 so that the slab 1 is deformed. Warpage of the slab 1 can be straightened by utilizing this deformation. It is preferable that a cooling device for the slab 1 is provided immediately below the slab warpage detection apparatus 20 according to the present embodiment.

In the present embodiment, the slab 1 having a thickness of 50 mm or greater in a cross section perpendicular to the drawing direction of the slab 1 is preferably used. In a case where the slab 1 satisfies this condition, a problem of warpage of the slab 1 is manifested, and the slab warpage detection apparatus 20 according to the present embodiment is preferably used. The cross-sectional shape of the slab 1 may be a rectangular shape, a circular shape, an elliptic shape, an H-shape or the like.

As in the continuous casting equipment 10 according to the present embodiment, the slab warpage detection apparatus 20 is provided between the roll segment 13 and the cutters 15. Therefore, particularly, before the slab 1 is drawn downward in the vertical direction and the slab 1 is cut into predetermined lengths by the cutters 15, it is possible to prevent the slab 1 from riding on the conveying rolls 17 which support a slab on a side below the cutters 15, to prevent the slab 1 from being not able to be supported any longer, and to prevent an operation from stopping.

In addition, the continuous casting equipment 10 according to another embodiment of the present invention includes the mold 11, the roll segment 13 that is disposed in a plurality of stages below this mold 11 and supports the slab 1 drawn from the mold 11, and the slab warpage detection apparatus 20 that detects warpage of the slab 1 drawn from the mold 11. The continuous casting equipment 10 includes the slab warpage detection apparatus 20 that has the pair of pressing rolls 21 pinching the slab 1 on the exit side of the roll segment 13, the movement units 24 supporting this pair of pressing rolls 21 to be movable in the thickness direction of the slab 1, and the position detecting units 28 detecting the positions of the pressing rolls 21 in the thickness direction of the slab; the cutters 15 that cut the slab 1; and the lower conveying rolls 17 that support and convey the stab 1 on a side below the cutters 15.

In addition, the method according to still another embodiment of the present invention is a method including detecting of warpage of the slab 1 by causing the position detecting unit 28 to detect the positions of the pressing rolls 21 when the pair of pressing rolls 21 move in the thickness direction of the slab 1 in a manner following the shape of the slab 1 in a state where the slab 1 is pinched by the pair of pressing rolls 21 by using the continuous casting equipment 10 including the mold 11, the roll segment 13 that is disposed in a plurality of stages below this mold 11 and supports the slab 1 drawn from the mold 11, and the slab warpage detection apparatus 20 that detects warpage of the slab 1 drawn from the mold 11. The continuous casting equipment 10 includes the slab warpage detection apparatus 20 that has the pair of pressing rolls 21 pinching the slab 1 on the exit side of the roll segment 13, the movement units 24 supporting this pair of pressing rolls 21 to be movable in the thickness direction of the slab 1, and the position detecting units 28 detecting the positions of the pressing rolls 21 in the thickness direction of the slab 1; the cutters 15 that cut the slab 1; and the lower conveying rolls 17 that support and convey the slab 1 on a side below the cutters 15.

EXAMPLE

Hereinafter, the results of an experiment performed to confirm the effects of the present invention will be described.

A slab having a rectangular cross section with a thickness of 250 mm and a width of 2,200 mm was subjected to continuous casting using continuous casting equipment (vertical-type continuous casting apparatus) described in the present embodiment.

In Comparative Example, the slab warpage detection apparatus was not provided, and warpage was not straightened.

In Example of the present invention, the slab warpage detection apparatus described in the present embodiment was used. Here, A distance A between a pair of pressing rolls on the upper side and a pair of pressing rolls on the lower side in FIG. 4 was set to 600 mm, and A distance B between the pair of pressing rolls on the lower side and a lower conveying roll was set to 5,660 mm.

In addition, from the past performance, a lower conveying roll, which had a size used when the slab rode an the lower conveying roll and conveyance stopped in a case where the warpage amount of a slab in the lower conveying roll became 30 mm or greater, was used.

In regard to pressing forces of the pair of pressing rolls, pressing forces of both rolls were set to be approximately equal to each other. Specifically, a pressing force of one pressing roll was set to 100 t, and a pressing force of the other pressing roll was set to 92 t.

In addition, in a case where the warpage amount in the lower conveying roll was estimated to be 20 mm or greater, warpage was straightened such that the warpage amount of a slab became 5 mm or smaller by adjusting the positions of the pair of pressing rolls through servo control.

Table 1 shows the comparison results of a situation of Example of the present invention (Example A of the present invention) in which no warpage was generated, a situation (Example B of the present invention) in which warpage was generated, and a situation of Comparative Example in which warpage was generated.

In addition, Table 2 shows the evaluation results of the casting length and the number of conveyance stops due to slab warpage between Example of the present invention and Comparative Example.

TABLE 1

| | Comparative Example | Example A of present invention | Example B of present invention |
|---|---|---|---|
| Positions of the pressing rolls on upper side (mm) | — | 0.5 | 4.3 |
| Positions of the pressing rolls on lower side (mm) | — | 0.6 | 9.2 |
| Warpage amount in lower conveying rolls (mm) | — | 1.6 | 46.2 |
| Sensing of warpage of slab | x | Absent | Present |
| Straightening of warpage of slab | Absent | Absent | Present |
| Interference with lower conveying rolls | Present | Absent | Absent |

TABLE 2

| | Comparative Example | Example of present invention |
|---|---|---|
| Casting length | 27,284 | 23,520 |
| The number of conveyance stops due to slab warpage | 3 | 0 |

In Comparative Example, warpage of a slab could not be detected and a slab rode on the lower conveying roll due to warpage of the slab. Then, conveyance of the slab stopped. Such a convey stop occurred three times in the middle of the casting length of 27,284 m.

In contrast, in Example of the present invention, warpage was sensed by the slab warpage detection apparatus at the exit part of the roll segment, and the warpage amount of the position of the lower conveying roll was assumed.

In Example A of the present invention, it was assumed that the warpage amount in the part of the lower conveying roll calculated from the amount of displacement of the position of the pressing roll on the upper side and the amount of displacement of the position of the pressing roil on the lower side became 1.6 mm (smaller than 20 mm). Therefore, even if straightening of warpage was not performed, a slab did not ride on the lower conveying roll, and a convey stop due to warpage of the slab caused in the middle of the casting length of 23,520 m did not occur.

In Example B of the present invention, it was assumed that the warpage amount in the part of the lower conveying roll calculated from the amount of displacement of the position of the pressing roll on the upper side and the amount of displacement of the position of the pressing roll on the lower side became 46.2 mm (20 mm or greater). Therefore, straightening of warpage was performed. Consequently, a slab did not ride on the lower conveying roll, and a convey stop due to warpage of the slab caused in the middle of the casting length of 23,520 m did not occur.

As described above, according to the present invention, it was confirmed that warpage of a slab drawn from a mold was detected in an early stage and the warpage amount thereof could be measured. Accordingly, occurrence of a convey stop due to warpage of a slab can be prevented, and an operation can be stably performed.

BRIEF DESCRIPTION OF THE REFERENCE SYMBOLS

1 slab
10 continuous casting equipment
11 mold
13 roll segment
14 pinching roll
15 cutter
17 lower conveying roll
20 slab warpage detection apparatus
21 pressing roll
24 movement unit
28 position detecting unit
30 control device

The invention claimed is:

1. A slab warpage detection apparatus detecting warpage of a slab drawn from a mold in continuous casting equipment, the slab warpage detection apparatus comprising:

a pair of pressing rolls that pinches the slab on an exit side of a roll segment supporting the slab drawn from the mold;

a pair of movement units, each movement unit of the pair of movement units configured to support a respective pressing roll of the pair of pressing rolls, each of the pressing rolls of the pair of pressing rolls configured to be movable in a thickness direction of the slab;

a position detecting unit that detects positions of each of the pressing rolls in the thickness direction of the slab; and a control device programmed to:

receive information of the position of each of the pressing rolls detected by the position detecting unit;

determine whether an amount of displacement of the positions of each of the pressing rolls in the thickness direction of the slab exceeds a predetermined value; and adjust pressing forces of the pair of pressing rolls to straighten warpage of the slab in a case where the amount of displacement of the positions of the pressing rolls in the thickness direction of the slab exceeds the predetermined value;

wherein the movement unit comprises a cylinder and a rod portion disposed to be retractable from the cylinder, and the pressing rolls are provided at a tip of the rod portion, wherein the position detecting unit is connected to the control device, and wherein the warpage of the slab is straightened by generating a difference between pressing forces of the respective pressing roll of the pair of pressing rolls and applying a bending deformation to the slab.

2. The slab warpage detection apparatus according to claim 1, wherein the slab having a center solid phase ratio of 70% or higher is used as a detection target.

3. The slab warpage detection apparatus according to claim 1, wherein the continuous casting equipment is vertical-type continuous casting equipment.

4. A method of detecting warpage of the slab using the slab warpage detection apparatus according to claim 1, the method comprising:

detecting warpage of a slab by causing the position detecting unit to detect the positions of the pressing rolls when the pair of pressing rolls moves in the thickness direction of the slab in a manner following a shape of the slab in a state where the slab is pinched by the pair of pressing rolls; and straightening warpage of the slab by adjusting pressing forces of the pair of pressing rolls in a case where an amount of displacement of the positions of the pressing rolls in the thickness direction of the slab exceeds a predetermined value.

5. The slab warpage detection apparatus according to claim 2, wherein the continuous casting equipment is vertical-type continuous casting equipment.

6. A method of detecting warpage of the slab using the slab warpage detection apparatus according to claim 2, the method comprising:

detecting warpage of a slab by causing the position detecting unit to detect the positions of the pressing rolls when the pair of pressing rolls moves in the thickness direction of the slab in a manner following a shape of the slab in a state where the slab is pinched by the pair of pressing rolls; and straightening warpage of the slab by adjusting pressing forces of the pair of pressing rolls in a case where an amount of displacement of the positions of the pressing rolls in the thickness direction of the slab exceeds a predetermined value.

7. A method of detecting warpage of the slab using the slab warpage detection apparatus according to claim 3, the method comprising:

detecting warpage of a slab by causing the position detecting unit to detect the positions of the pressing rolls when the pair of pressing rolls moves in the thickness direction of the slab in a manner following a shape of the slab in a state where the slab is pinched by the pair of pressing rolls; and straightening warpage of the slab by adjusting pressing forces of the pair of pressing rolls in a case where an amount of displacement of the positions of the pressing rolls in the thickness direction of the slab exceeds a predetermined value.

8. A method of detecting warpage of the slab using the slab warpage detection apparatus according to claim 5, the method comprising:

detecting warpage of a slab by causing the position detecting unit to detect the positions of the pressing rolls when the pair of pressing rolls moves in the thickness direction of the slab in a manner following a shape of the slab in a state where the slab is pinched by the pair of pressing rolls; and straightening warpage of the slab by adjusting pressing forces of the pair of pressing rolls in a case where an amount of displacement of the positions of the pressing rolls in the thickness direction of the slab exceeds a predetermined value.

* * * * *